United States Patent [19]

Breimeier et al.

[11] Patent Number: 4,640,054

[45] Date of Patent: Feb. 3, 1987

[54] SASHES AND MATCHING FRAMES FOR WINDOWS AND GLASS DOORS

[75] Inventors: Kurt Breimeier, Wunstorf; Heinrich Eickhoff, Neustadt; Hans-Walter Erdmann, Garbsen; Hans D. Kühnel, Minden, all of Fed. Rep. of Germany

[73] Assignee: Fulgurit GmbH & Co., Kommanditgesellschaft, Wunstorf, Fed. Rep. of Germany

[21] Appl. No.: 692,966

[22] Filed: Jan. 22, 1985

[30] Foreign Application Priority Data

Jan. 24, 1984 [DE] Fed. Rep. of Germany ..... 3402226

[51] Int. Cl.[4] ..... E06B 1/04

[52] U.S. Cl. ..... 49/504; 49/DIG. 1; 52/309.4; 52/309.9; 52/403

[58] Field of Search ..... 49/504, 501, DIG. 1, 49/400; 52/309.4, 309.8, 309.9, 403

[56] References Cited

U.S. PATENT DOCUMENTS 3,012,642 12/1961 Emmerich ..... 52/403 X 4,227,346 10/1980 Kubik ..... 49/504 X 4,314,424 2/1982 Gordon et al. ..... 49/DIG. 1 X 4,524,112 6/1985 Willert ..... 49/504 X

FOREIGN PATENT DOCUMENTS 2033442 1/1972 Fed. Rep. of Germany ... 49/DIG. 1

2930539 3/1981 Fed. Rep. of Germany ... 49/DIG. 1

*Primary Examiner*—Philip C. Kannan

*Attorney, Agent, or Firm*—Wells & Wells

[57] ABSTRACT

Sashes and matching frames for windows and glazed doors, of which the shaped sections each consist of at least one inner hollow aluminum shaped section and one outer plastic casing are designed to substantially improve their thermal insulation.

The invention provides a two-part hollow aluminum shaped section, the partial shaped sections so formed being separated thermally from each other approximately in the central region of the shaped section and the thermal separation consisting of the plastic of the outer coverings of the two partial shaped sections.

10 Claims, 3 Drawing Figures

SASHES AND MATCHING FRAMES FOR WINDOWS AND GLASS DOORS

BACKGROUND OF THE INVENTION

The invention concerns sashes and matching frames for windows and glazed doors of which the shaped sections each consists of at least one inner hollow aluminum shaped section and one outer plastic casing.

In prior art frames of this kind the hollow aluminum shaped section is completely enclosed by the plastic casing whereby the aluminum hollow shaped section is covered both with respect to the inside and the outside of the room. Such an arrangement is advantageous in that the hollow aluminum shaped section is not directly exposed to the temperatures either inside or outside the room and accordingly the aluminum hollow shaped section is at a mean temperature whereby excessive shear forces arising from the different thermal expansion coefficients of the two materials are avoided.

However the prior art design suffers from the drawback that the hollow aluminum shaped section—which in the known design extends from the inside to the outside of the room, amounts to a thermal bridge introducing the inside temperature to the outside and vice-versa. The heat insulation which can be achieved by such an arrangement therefore must be unsatisfactory.

SUMMARY OF THE INVENTION

It is accordingly the object of the invention to so design a sash and matching frame of the initially cited kind in such a manner that while retaining the advantages of the known design, it shall also substantially improve thermal insulation.

This problem is solved by the present invention in that the hollow aluminum shaped section consists of two parts, the two partial sections so formed being thermally separated from each other approximately centrally in the shaped section and the thermal separation consisting of the plastic outwardly covering the two partial shaped sections.

This arrangement makes it possible to make each shaped section into a five-layer assembly, namely a first plastic layer at the room outside, an adjoining hollow aluminum shaped section, an adjoining second plastic layer, an adjoining second hollow aluminum shaped section and a plastic layer facing the room inside. The alternating arrangement of such layers differing in their thermal insulations offers the advantage that the thermal insulation is substantially improved over the known design because thermal bridges are no longer formed. Moreover the inwardly and outwardly covered hollow aluminum shaped sections act as further insulating layers due to the air inclusions provided therein because heat conduction to the particular other side is no longer possible through the outside wall of the hollow shaped sections.

Another advantage offered by the arrangement of the invention is that the two thermally separated hollow aluminum shaped sections can assume different temperatures whereby their elongations and shrinkages shall less affect the neighboring plastic sections than in the known design.

In particular the arrangement of the invention makes it possible to have outstanding insulating properties and simultaneously the outside surfaces of the hollow aluminum shaped sections can be open at least in part toward the wall and/or the side of the glass and/or the closing area, whence accessories such as seals, glazing stops and the like can be mounted in simple manner in receiving grooves or between T-strips on the outsides of the hollow aluminum shaped sections. Furthermore the matching frame can also be anchored thereby by means of the hollow aluminum shaped sections into the masonry without significantly degrading the thermal insulation.

In particular at least one receiving groove to receive at least one seal may be formed between two adjoining T strips or the like of the two neighboring parts of the hollow aluminum shaped sections, the bottom of this groove being formed by the plastic in the region of thermal separation.

Depending on the particulars, each shaped section also can be designed so that the plastic forming the thermal separation between the two hollow aluminum shaped sections is integral with at least one of the two outside plastic coverings.

Depending on the contour of the shaped sections and on the particular static conditions, it may be appropriate to so introduce the plastic in the area of the thermal separation during the process of manufacture that a relatively high gross density is obtained in order to achieve the required properties of mechanical strength.

BRIEF DESCRIPTION OF THE DRAWINGS

The invention is discussed below in further detail in relation to the embodiments shown in the drawing.

DESCRIPTION OF THE PREFERRED EMBODIMENTS

Figure 1:
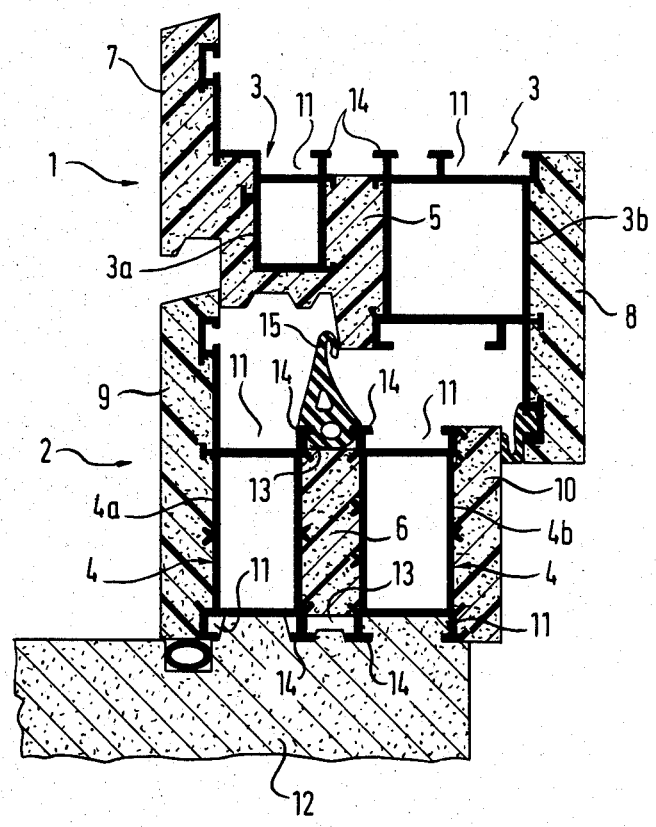
FIG. 1 is a section of the shaped sections of the invention used for a window sash and matching frame.

As shown in FIG. 1, the shaped sections of a sash 1 and a matching frame 2 each consist of a two-part hollow aluminum shaped section 3 and 4, where the partial shaped sections **3*a* and 3*b* and 4*a* and 4*b* are thermally separated from each other by the plastics 5 and 6 resp. approximately in the central area of the shaped section. The plastic of the thermal separations 5 and 6 corresponds to the plastic forming the outer covers 7 and 8 of the sash section and 9 and 10** of the matching frame section.

Each shaped section consists of five layers and consists of three plastic plies and two layers of hollow aluminum always alternating between them.

As shown, the outsides of the hollow aluminum shaped sections **3*a*,3*b* and 4*a*,4*b* may be open toward the wall and/or the glass side and/or the closing region, possibly receiving-grooves 11 being provided at the open outsides of the hollow aluminum shaped sections to either receive accessories such as seals, glazing stops or the like or to be used for anchoring into the masonry 12 on the side of the matching frame. However such grooves 13 can also be formed between two adjoining T strips 14 or the like of the adjoining partial shaped sections 3*a*,3*b* and 4*a*,4*b* of the hollow aluminum shaped sections 3 and 4**.

A seal 15 is seated in the embodiment of FIG. 1 between two adjoining T strips 14 of the two partial shaped sections **4*a* and 4*b* of the fixed frame 2**.

Furthermore, the plastic 5 forming the thermal separation in FIG. 1 is integrally joined to the outside plastic cover 7.

Figure 2:
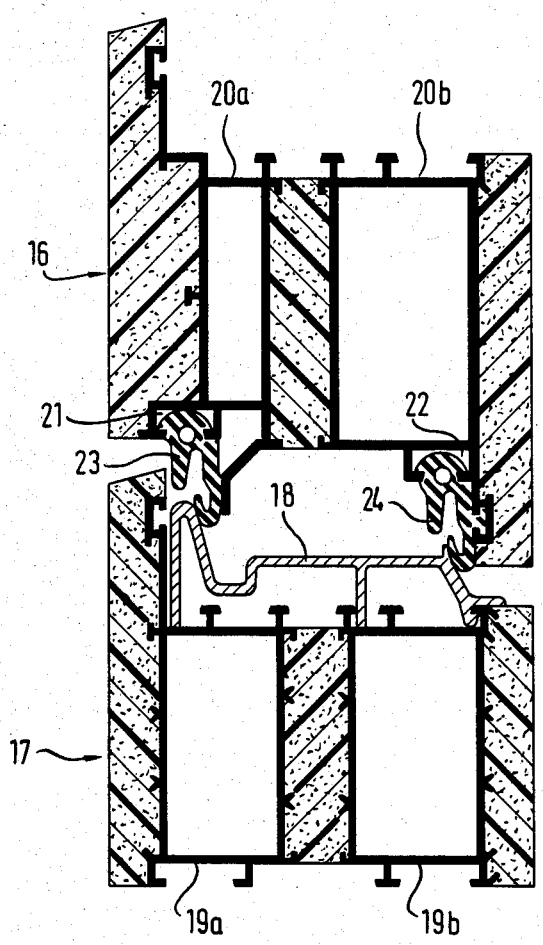
FIG. 2 is a section similar to the one of FIG. 1 showing the shaped sections for door frames.

FIG. 2 illustratively shows applying the invention to a house door provided with a fixed frame 17 and a sash 16. As shown by FIG. 2, a metal stop 18 is provided which is anchored both in the grooves of the first hollow aluminum shaped section 19*a* of the fixed frame and in the associated hollow aluminum second shaped section 19*b*.

In the associated sash shaped section 16, the grooves 21 and 22, which are open toward the closing area, of the hollow aluminum shaped sections 20*a* and 20*b* of the matching shaped section receive seals 23 and 24 which in the closed condition come to rest against the stop strip 18.

Figure 3:
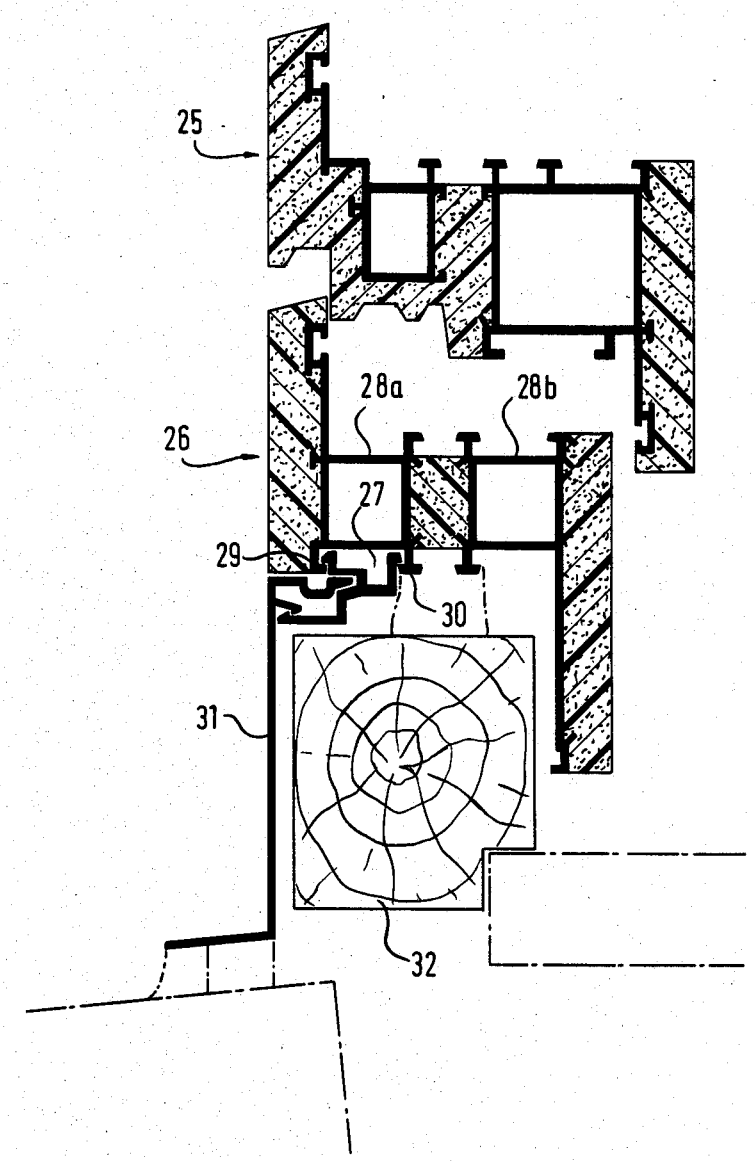
FIG. 3 is a section similar to that of FIG. 1 illustratively showing the possible connections of the hollow aluminum shaped sections to the open outside surfaces.

FIG. 3 shows an embodiment of which the sash shaped section 25 corresponds to that of FIG. 1 whereas the fixed-frame shaped section 26 is provided with a groove 27 open toward the anchoring side and located in the first hollow aluminum shaped section 28*a* of which the shapes 29 and 30 bounding said groove form an indexing connection with a metallic shaped section 31 covering a wood frame 32. The outwardly open grooves of the outsides of the hollow aluminum shaped sections may engage in corresponding manner further accessories or anchoring parts.

We claim:

1. A composite shaped section for sashes or jambs for windows or glazed doors and comprising in its installed state:

(a) first and second aluminum hollow shaped sections each of which has an outer vertical surface, an inner vertical surface, a top horizontal surface and a bottom horizontal surface;

(b) each of said aluminum hollow shaped sections having a given plastic coating material covering said outer surfaces; and (c) a thermal separation between said inner surfaces consisting of said given plastic coating material.

2. The composite shaped section of claim 1, wherein said top and bottom horizontal surfaces are provided with receiving grooves.

3. The composite shaped section of claim 1, wherein at least one receiving groove adapted to seat at least one seal is located between said inner surfaces of said aluminum shaped sections, said receiving groove having a groove bottom defined by said plastic coating material in the region of said thermal separation.

4. The composite shaped section of claim 1, wherein said plastic material defining said thermal separation between said aluminum hollow shaped sections is integral with at least one of said coverings.

5. The composite shaped section of claim 1, wherein said plastic material in the region of said thermal separation has a relatively high apparent density.

6. A composite shaped section for sashes or jambs for windows or glazed doors comprising in its installed state:

(a) first and second aluminum hollow shaped sections each of which has an outer vertical surface, an inner vertical surface, a top horizontal surface and a bottom horizontal surface;

(b) each of said aluminum hollow shaped sections having a given plastic coating material covering portions of said outer surfaces; and (c) a thermal separation between said inner surfaces consisting of said given plastic coating material.

7. The composite shaped section of claim 6, wherein said top and bottom horizontal surfaces are provided with receiving grooves.

8. The composite shaped section of claim 6, wherein at least one receiving groove adapted to seat at least one seal is located between said inner surfaces of said aluminum shaped sections, said receiving groove having a groove bottom defined by said plastic coating material in the region of said thermal separation.

9. The composite shaped section of claim 6, wherein said plastic material defining said thermal separation between said aluminum hollow shaped sections is integral with at least one of said coverings.

10. The composite shaped section of claim 6, wherein said plastic material in the region of said thermal separation has a relatively high apparent density.

* * * * *